US012352545B2

(12) United States Patent
Peterson

(10) Patent No.: US 12,352,545 B2
(45) **Date of Patent: *Jul. 8, 2025**

(54) REDUCED STIFFNESS BARREL FIRED PROJECTILE

(71) Applicant: Federal Cartridge Company, Anoka, MN (US)

(72) Inventor: Bryan P. Peterson, Isanti, MN (US)

(73) Assignee: Federal Cartridge Company, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/244,046

(22) Filed: Sep. 8, 2023

(65) Prior Publication Data

US 2024/0093980 A1 Mar. 21, 2024

Related U.S. Application Data

(63) Continuation of application No. 17/745,266, filed on May 16, 2022, now Pat. No. 11,781,843, which is a continuation of application No. 16/513,377, filed on Jul. 16, 2019, now Pat. No. 11,333,472.

(60) Provisional application No. 62/698,450, filed on Jul. 16, 2018.

(51) Int. Cl.

| | |
|---|---|
| ***F42B 14/00*** | (2006.01) |
| ***F42B 5/28*** | (2006.01) |
| ***F42B 12/74*** | (2006.01) |

(52) U.S. Cl.

CPC ..... *F42B 14/00* (2013.01); *F42B 5/28* (2013.01); *F42B 12/74* (2013.01)

(58) Field of Classification Search

CPC ..... F42B 14/00; F42B 5/28; F42B 12/74

See application file for complete search history.

(56) References Cited

U.S. PATENT DOCUMENTS

| | | | |
|---|---|---|---|
| 760,338 | A | 5/1904 | Kwiatkowski |
| 871,825 | A | 11/1907 | Schupmann |
| 1,081,616 | A | 12/1913 | Johnson |
| 1,531,624 | A | 3/1925 | Richardson |
| 2,336,143 | A | 12/1943 | Werme |
| 3,349,711 | A | 10/1967 | Julius |

(Continued)

FOREIGN PATENT DOCUMENTS

| | | | |
|---|---|---|---|
| DE | 309293 | C | 1/1920 |
| RU | 2413169 | C1 | 2/2011 |

(Continued)

*Primary Examiner* — Michelle Clement

(74) *Attorney, Agent, or Firm* — Christensen, Fonder, Dardi & Herbert PLLC; Timothy J. Busse

(57) ABSTRACT

In various embodiments, a projectile includes a projectile body including a tail portion, a nose portion, a barrel engaging portion between the nose portion and the tail portion, and a metal jacket that defines an exterior of the projectile that surrounds an interior solid core. In one or more embodiments the projectile includes one or more circumferential grooves defined in the interior core portion, each of the one or more circumferential grooves covered by and positioned adjacent to the metal jacket and within the barrel-engaging portion. In various embodiments, during firing of the projectile, the one or more circumferential grooves define a void that allows material of one or more of the metal jacket and interior solid core to displace into the void for reduction in radial stiffness to the projectile in the barrel engaging portion.

20 Claims, 14 Drawing Sheets

(56) References Cited

U.S. PATENT DOCUMENTS

| | | | |
|---|---|---|---|
| 4,338,862 | A | 7/1982 | Kwatnoski |
| 4,850,278 | A | 7/1989 | Dinkha |
| 4,854,242 | A | 8/1989 | Katzmann |
| 4,939,996 | A | 7/1990 | Dinkha |
| 5,063,855 | A | 11/1991 | Diel |
| 5,097,768 | A | 3/1992 | Petrovich |
| 5,164,538 | A | 11/1992 | McClain, III |
| 5,686,693 | A | 11/1997 | Jakobsson |
| 5,909,003 | A | 6/1999 | Burri |
| 6,629,669 | B2 | 10/2003 | Jensen |
| 6,679,178 | B2 | 1/2004 | Mihaylov et al. |
| 7,210,411 | B2 | 5/2007 | Booth |
| 7,222,573 | B2 | 5/2007 | Pontieri |
| 7,299,750 | B2 | 11/2007 | Schikora et al. |
| 7,752,977 | B1 | 7/2010 | Babcock et al. |
| 7,765,934 | B2 | 8/2010 | Spatz et al. |
| 7,823,510 | B1 | 11/2010 | Hobart et al. |
| 7,900,561 | B2 | 3/2011 | Marx |
| 7,980,180 | B2 | 7/2011 | MacDougall |
| 8,074,574 | B2 | 12/2011 | Riess et al. |
| 8,857,343 | B2 | 10/2014 | Marx |
| 8,950,333 | B2 | 2/2015 | Burczynski et al. |
| D732,635 | S | 6/2015 | Riley et al. |
| 9,335,230 | B1 | 5/2016 | Hooke |
| 9,470,494 | B2 | 10/2016 | Marx |
| 10,578,413 | B1 | 3/2020 | Burke |
| 10,989,507 | B2 | 4/2021 | Thompson |
| 11,041,692 | B1 | 6/2021 | Chromych |
| 11,181,352 | B1 | 11/2021 | Smitchko |
| 2005/0000385 | A1 | 1/2005 | Booth |
| 2010/0175576 | A1 | 7/2010 | Weeks et al. |
| 2012/0180690 | A1 | 7/2012 | Masinelli et al. |
| 2013/0167747 | A1 | 7/2013 | Luchini et al. |
| 2016/0153757 | A1 | 6/2016 | Mahnke |
| 2017/0108320 | A1 | 4/2017 | Peterson |
| 2017/0205215 | A1 | 7/2017 | Sloff et al. |
| 2017/0234665 | A1 | 8/2017 | Reilly |
| 2018/0156584 | A1 | 6/2018 | Peterson |
| 2018/0209768 | A1 | 7/2018 | Peterson |
| 2018/0245896 | A1 | 8/2018 | Burczynski |
| 2020/0248997 | A1 | 8/2020 | McLaren |
| 2021/0063130 | A1 | 3/2021 | Muster |

FOREIGN PATENT DOCUMENTS

| | | |
|---|---|---|
| WO | WO 90/01669 A1 | 2/1990 |
| WO | WO 99/31454 A1 | 6/1999 |

REDUCED STIFFNESS BARREL FIRED PROJECTILE

This application is a continuation of U.S. patent application Ser. No. 17/745,266, filed May 16, 2022, which is a continuation of U.S. patent application Ser. No. 16/513,377, filed Jul. 16, 2019 now U.S. Pat. No. 11,333,472, and claims the benefit of U.S. Provisional Application No. 62/698,450, filed Jul. 16, 2018, the disclosures of each are incorporated by reference herein.

FIELD OF THE DISCLOSURE

The present disclosure relates to projectiles, and more specifically, to rifled barrel fired projectiles including a metal jacket.

BACKGROUND

Bullets generally need to obturate or seal with the rifled barrel in order to maximize the energy transfer from the expanding propellant gases to the bullet. Rifle bullets have a conventional elongate shape with pointed tip. The elongate shape increases the bullet metal surface area contacting the metal barrel during firing and the metal to metal, barrel to bullet, friction can reduce the muzzle velocity of the bullet. It is known to reduce the bullet to barrel contact area to reduce friction. Bullets are known having rearward ends with a boat tail and circumferential grooves, both of which have the effect of reducing the surface area of elongate bullet and the metal to metal engagement and friction. Such grooves in rifle bullets have previously been exposed or filled with grease for lubrication between the barrel and bullet. However, bullets with grooves filled with grease are not commercially feasible in today's market.

Innovations providing even incremental improved performance of bullets would be welcome in the marketplace, and providing such improved performance with minimal increase in manufacturing cost would be very advantageous.

SUMMARY

Adding outer exposed circumferential grooves to a barrel fired projectile or bullet can result in greater muzzle velocity. For example, such grooves can reduce metal to metal contact between a projectile and a rifled barrel from a reduction in surface area on the projectile that directly contacts the rifled barrel during firing as long as the bullet obturation is not detrimentally affected by the reduction in surface area.

Rifled barrels have grooves and lands that spiral the length of the barrel. The barrel has a maximum inside diameter measured between opposing groove surfaces and a minimum inside diameter measured between opposing lands. The radial dimension between the lands and grooves are typically a few thousandths, for example 0.002 to 0.010 inches. Jacketed bullets with lead cores may be sized diametrically to slight exceed the maximum groove to groove diameter of the barrel due to the high deformability of the lead core. Bullets with steel cores or materials stiffer than lead need to have a steel core diameter of less than the land to land minimum diameter to avoid excessive barrel wear.

In addition, such grooves can reduce the overall radial stiffness of the projectile by allowing barrel-engaging material to displace into the circumferential grooves and thereby reduce the needed energy to deform the projectile surface by the barrel rifling. Both of these factors can provide a noticeable increase in projectile muzzle velocity.

These improvements are particularly notable with projectiles having elements that are constructed from materials with a higher stiffness than lead, such as copper, brass, steel, or other higher stiffness material. In such instances, the reduction in the needed energy to deform the projectile surface by the barrel rifling reduces the wear on barrel rifling from the high stiffness projectile material. The result is that the grooved projectile not only improves muzzle velocity, improves the lifespan of the barrel, and reduces force transmitted to the barrel, thus in turn reducing barrel motion resulting in a more accurate weapon system.

However, grooving the exterior body of a projectile is not without penalty, as the addition of grooves can increase the aerodynamic drag on the projectile while projectile is in-flight. As a result, such grooves can increase the rate of projectile deceleration as the projectile travels down range. This is disadvantageous, as barrel fired projectiles are generally designed to have minimal decrease in velocity as they travel down range, as quantified by a "ballistic coefficient". In various instances, the higher the ballistic coefficient the more effective the projectile.

For example, it is estimated that the addition of single circumferential groove to a rifle bullet will decrease the ballistic coefficient of that projectile by about 3%. Since many projectiles utilize 3 or more grooves, it is very easy to realize a 10% drag increase through the use of grooving. This increase in drag manifests itself in lower down range velocities and thus a reduction in effectiveness.

In addition, grooving techniques are difficult to implement with traditional jacketed projectiles as traditional projectile jackets are too thin (e.g. 0.015"-0.020") to groove effectively and still provide enough strength and integrity to survive launch. As such, grooving has typically only been used on solid-shank projectiles and jacketed projectiles, such as the M855A1 and others, do not currently utilize any method to reduce the radial stiffness of the projectile.

Embodiments of the disclosure provide benefits in a projectile that is designed to realize the benefits of grooving while avoiding the associated increase in projectile drag. As a result various embodiments provide a projectile with increased accuracy/dispersion and improve barrel lifespan through the reduction of friction and heat. In addition, various embodiments provide a projectile that can utilize a conventional jacketed design while also realizing the benefits of grooving.

As such, one or more embodiments are directed to a projectile including a projectile body having a tail portion, a nose portion, a barrel engaging portion between the nose portion and the tail portion. In one or more embodiments the projectile includes a metal jacket that defines an exterior of the projectile that surrounds an interior solid core. In one or more embodiments the projectile includes one or more circumferential grooves defined in the interior core portion, each of the one or more circumferential grooves covered by and positioned adjacent to the metal jacket and within the barrel-engaging portion. In various embodiments, during firing of the projectile, the one or more circumferential grooves define a void that allows material of one or more of the metal jacket and interior solid core to displace into the void for reduction in radial stiffness to the projectile in the barrel engaging portion thereby reducing the energy necessary to groove the bullet by the rifling.

The friction of the metal to metal contact is directly dependent upon the deformability or stiffness of the bullet metal engaging the barrel or the stiffness of the metal at the lands of the barrel, and of course, the tightness of the fit between the barrel and the bullet surface. The inventors have discovered that facilitating deformation of the jacket of the bullet, that is reducing the overall stiffness of the bullet surface that engages the rifling, when using bullets with non-lead cores, reduces the overall bullet to barrel friction, increasing the muzzle velocity of the bullets.

The friction of the metal to metal contact is also directly dependent upon the deformability or stiffness of the bullet metal engaging the barrel and the fit between the barrel and the bullet surface. The inventors have discovered that facilitating deformation of the jacket of the bullet, that is, reducing the overall stiffness of the bullet surface that engages the rifling, reduces the overall bullet to barrel friction.

In embodiments of the invention, a jacketed bullet, have a core harder than lead, has at least three uniform sized grooves, uniformly spaced on the core and positioned below the jacket at a barrel engaging portion of the jacket. In embodiments, the jacket comprises copper and the core comprises steel or copper. In embodiments of the invention, a jacketed bullet, have a core harder than lead, has at least four uniform sized grooves, uniformly spaced on the core and positioned below the jacket at a barrel engaging portion of the jacket. In embodiments, the jacket comprises copper and the core comprises steel or copper.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
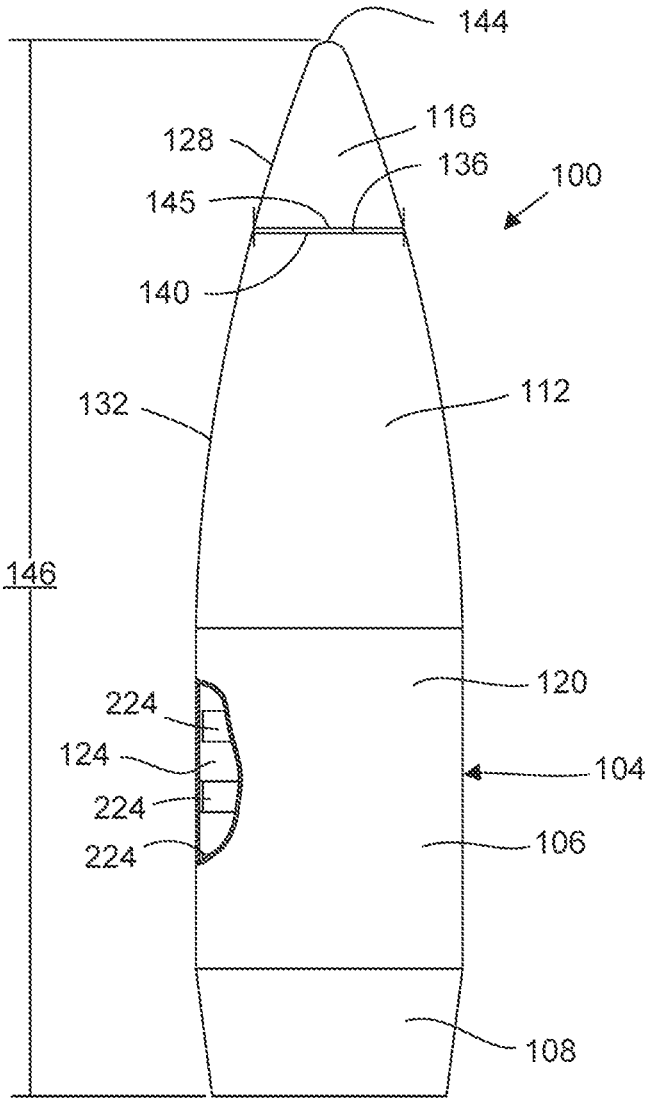
FIG. 1 depicts a side view of a projectile, according to one or more embodiments of the disclosure.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIG. 1, a side view of a projectile 100 is depicted according to one or more embodiments. The projectile 100 includes a projectile body 104 having a main body portion 106, a tail portion 108, and a nose portion 112.

In one or more embodiments, the projectile 100 is jacketed or plated, having a projectile body 104 that is composed of at least two parts including a metal jacket 120 that surrounds an interior sold core 124 depicted in FIG. 1 under a cutaway portion of the metal jacket 120.

In certain embodiments, the interior solid core 124 is composed of one or more of a variety of materials. In certain embodiments the interior solid core 124 could be composed of two or more portions where each portion is composed from a different material, such as aluminum, antimony, beryllium, bismuth, boron carbide, brass, bronze, chromium, cobalt, copper, gold, iridium, iron, lead, magnesium, mercury, molybdenum, nickel, palladium, platinum, rhodium, silicon carbide, silver, steel, tantalum, tellurium, tin, titanium, tungsten, tungsten carbide, depleted uranium, zinc and zirconium, an alloy, or other suitable material.

In certain embodiments, and described further below, the core 124 can include a forward penetrator portion making up a most forward portion of the interior core 124 and a plug portion that is positioned rearward of the penetrator portion. In such embodiments, the penetrator portion is composed of materials having a high stiffness or lesser malleability than the generally more malleable metal jacket 120 and/or plug portion. As such, in various embodiments the penetrator portion can configure the projectile 100 for penetration of hardened surfaces, armor, and the like. In certain embodiments the penetrator portion can be composed of steel, tungsten, or other suitable high strength material. In certain embodiments the penetrator portion is composed of materials having an approximate Young's modulus measurement of stiffness in the range of 20 Mpsi to 30 Mpsi.

In one or more embodiments, the plug portion can be composed of a variety of materials including copper, brass, a copper alloyed with another metal, lead, or other suitable material. In certain embodiments, the plug portion is composed of a material being generally more malleable than the penetrator portion for reducing barrel wear, and for other advantages. In certain embodiments, plug portion is composed of materials having an approximate Young's modulus measurement of stiffness in the range of 10 Mpsi to 20 Mpsi. In some embodiments, the plug portion is composed of a material having a higher density than the penetrator portion for increasing projectile mass, moving the center of gravity for the projectile 100, improving flight stability, or for other reasons.

In one or more embodiments the interior core 124 can be composed of from a single material. For example, in certain embodiments the interior core 124 is composed from a generally malleable material, relative to the metal jacket 120 for assisting in expansion of the projectile body 104 upon impact with a target. In some embodiments, the interior solid core 124 is composed of lead, alloyed lead, or other suitable core material for assisting in expansion of the projectile body 104 upon impact. In some embodiments, interior solid core 124 is composed of materials having a higher stiffness or lesser malleability than the generally malleable materials described above. For example in certain embodiments the interior solid core 124 is composed of copper, brass, a copper alloyed with another metal, steel or other suitable material. In certain embodiments, the interior solid core 124 is composed of materials having an approximate Young's modulus measurement of stiffness in the range of 10 Mpsi to 30 Mpsi.

In various embodiments, the plug portion and penetrator portion are separable from one another such that the metal jacket 120 keeps of the elements the projectile 100 together during flight to maintain an optimal aerodynamic shape. In certain embodiments, upon impact with a target the penetrator portion and plug portion are configured to break apart and function as individual projectiles upon impact of the larger projectile 100 with a target.

Described further below, in various embodiments, the metal jacket 120 is a continuous piece of metal extending from the tail portion 108 to the nose portion 112, and defines the exterior of the projectile 100. In various embodiments, the metal jacket 120 is composed of unalloyed copper, a copper alloyed with another metal, or other suitable projectile jacketing or plating material. For example, the metal jacket 120 may be composed of a copper-zinc alloy for covering the interior solid core 124 while firing the projectile from a barrel.

For additional discussion of projectiles see U.S. Pat. Nos. 7,748,325; 8,857,343; and 9,470,494. These patents are incorporated by reference herein in their entirety.

Described further herein, in one or more embodiments, the nose portion 112 includes a tip portion 116 that forms a spitzer aerodynamic shape for the total projectile 100 and that defines a most forward portion for the projectile 100.

In various embodiments the tip portion 116 is an exposed portion of the interior core 124 that is not covered by the metal jacket 120. In such embodiments, the metal jacket 120 terminates at a forward portion 140 where the tip portion 116 is exposed as a unitary structure having an exterior surface 128 that is substantially flush with an exterior surface 132 of the metal jacket 120 and extends from a rearward portion 136, which is positioned directly adjacent to a forward portion 140 of the metal jacket 120, to a forward point 144.

However, in certain embodiments, and described further below, the metal jacket 120 can cover the entirety of the interior core 124. In such embodiments, the metal jacket 120 extends from the tail portion 108 and covers the entirety of the tip portion 116.

In various embodiments, the tip portion 116 has a substantially pointed or ogive shape with a taper from the rearward portion 136 to the forward point 144 defined by an aspect ratio of the width 145 of the projectile 100 at the rearward portion 136 to the total length 146 of the projectile 100. In various embodiments, the aspect ratio is in the range of 6.00 to 10.00. In certain embodiments the aspect ratio is in the range of 7.00 to 8.00. However, in various embodiments the aspect ratio can be higher or lower depending on the design and type of projectile 100.

In various embodiments, projectile 100 can be sized according to various different calibers. For example, in certain embodiments, the projectile could be a .308 Winchester round, .17 HMR, .22 Hornet, .223 Remington, .223 WSSM, .243 Winchester, .257 Roberts, .270 Winchester, 7 mm Remington Magnum, .30-06 Springfield, .300 Winchester Magnum, .338 Winchester Magnum, .375 H&H, 45.70 Gov't, and .458 Winchester Magnum. However, in certain embodiments, the projectile 100 could be sized to various other types of calibers not listed, but known in the art.

Figure 2:
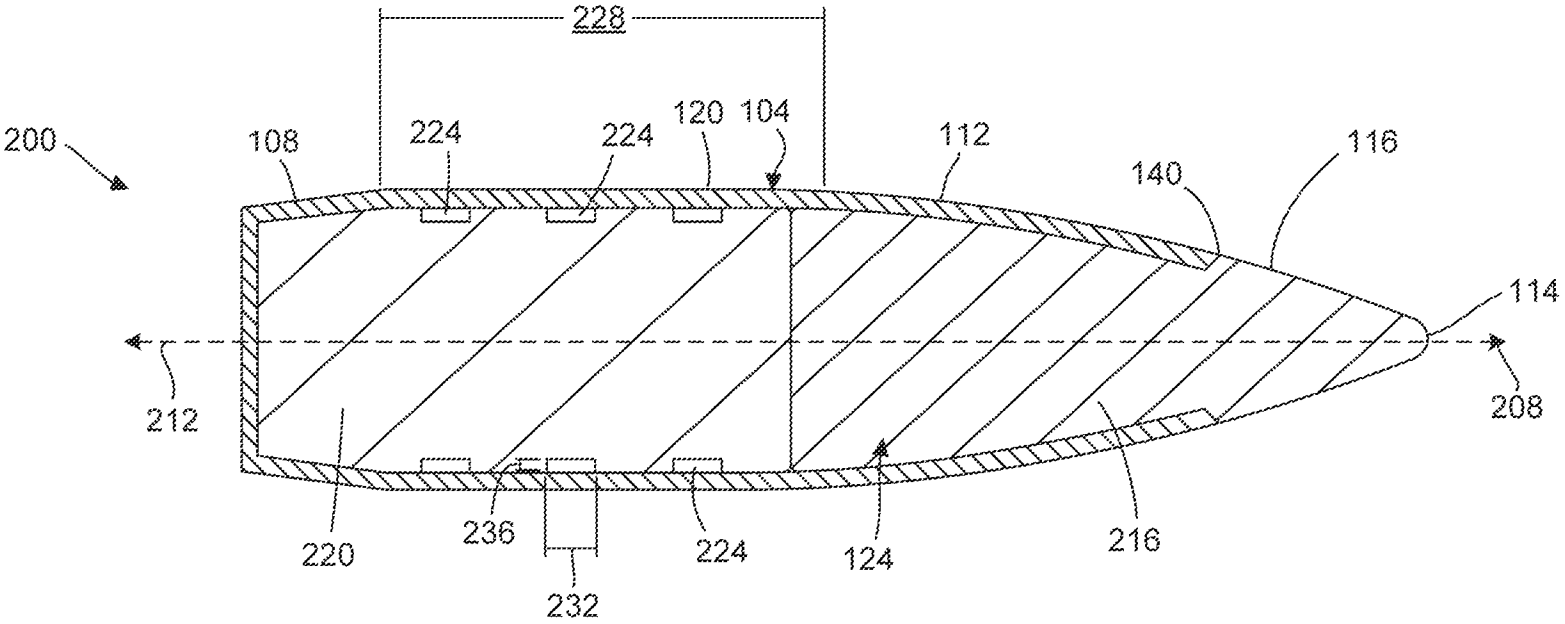
FIG. 2 depicts a cross-sectional view of a projectile, according to one or more embodiments of the disclosure.

Referring to FIG. 2, a cross-sectional view of a projectile 200 is depicted, according to one or more embodiments of the disclosure. In various embodiments, the projectile 200 shares one or more like elements with the projectile 100 of FIG. 1. As such, like elements are referred to with the same reference numbers.

Projectile 200 is jacketed, including a projectile body 104 composed of a metal jacket 120 extending from the tail portion 108 to the nose portion 112 and surrounding an interior solid core 124. The metal jacket 120 and nose portion 112 tapers in a forward direction, indicated by arrow 208 on a central axis 212. The metal jacket 120 extends to a forward portion 140 where the metal jacket terminates 120 and a tip portion 116 including an exposed portion of the interior solid core 124 is exposed. As described above, in various embodiments the tip portion 116 has an exterior surface 128 that is substantially flush with an exterior surface 132 of the metal jacket 120 and extends from a rearward portion 136 to a forward point 144.

Depicted in FIG. 2, the interior solid core 124 of the projectile 200 is composed of two portions including a penetrator portion 216 making up a most forward portion of the interior core 124 and a plug portion 220 that is positioned rearward of the penetrator portion 216. As described above, in various embodiment the penetrator portion 216 is composed of materials having a high stiffness or lesser malleability than the generally more malleable metal jacket 120 and/or plug portion 220. For example, in various embodiments the penetrator portion 216 is composed of steel, tungsten, or other suitable high strength material.

In one or more embodiments, the plug portion 220 can be composed of a variety of materials including copper, brass, a copper alloyed with another metal, lead, or other suitable material. In certain embodiments, the plug portion is composed of a material being generally more malleable than the penetrator portion for reducing barrel wear, and for other advantages.

In one or more embodiments the plug portion 220 includes a plurality of circumferential grooves 224. In various embodiments the circumferential grooves are voids or cutouts of material from the interior core portion 124. In one or more embodiments, each of the circumferential grooves 224 are positioned adjacent to the metal jacket 120 and within a barrel-engaging region 228 of the projectile 200. As used herein, the barrel-engaging region 228 includes the portion of the projectile that is extended furthest radially outward, relative to central axis 212, such they form the primary elements for contacting barrel rifling and imparting spin on the projectile 200 during firing.

Each of the circumferential grooves 224 have an axial width 232 and a radial depth 236. In certain embodiments, the circumferential grooves 224 have an axial width 232 in the range of 0.5 inches to 0.025 inches. In some embodiments, the circumferential grooves 224 have a radial depth in the range of 0.1 inches to 0.0025. In one or more embodiments the circumferential grooves 224 have an axial width 232 of approximately 0.05 inches and a radial depth 236 of approximately 0.005 inches. However, in certain embodiments, the size of the radial depth 236 and axial width 232 will be larger or smaller than the given ranges. For example, such dimensions could increase or decrease based on the size of the projectile. In various embodiments the grooves 224 are contemplated to extend inwardly 4 to 15% of the diameter of the projectile 200 in the barrel-engaging region 228.

In various embodiments, and described further below, the addition of circumferential grooves 224 to the interior core 124 allows jacket 120 material and/or interior core 124 material to flow and displace into the void left by the grooves 224 in a relatively unconstrained manner during firing of the projectile. As a result, in various embodiments, the circumferential grooves provides a significant reduction to overall stiffness to the projectile 200 over the barrel-engaging region 228.

In addition, because the circumferential grooves 224 are defined in the plug portion 220, the projectile 200 maintains maximum integrity of the metal jacket 120. As a result, the projectile 200 possesses a higher likelihood of staying intact during flight and maintaining an optimal aerodynamic shape for flight until impact with a target. For instance, in certain embodiments, where thinning of the metal jacket 120 occurs to define a circumferential groove, the overall structural integrity of the jacket 120 is weakened. In addition, the radial depth 236 of the groove is then limited by the thickness of the metal jacket 120.

While FIG. 2 depicts the circumferential grooves 224 as possessing a square or rectangular shape, other shapes, including an undercut shape, are contemplated. For example, in various embodiments the cross section of the grooves 224 may be, by way of example and not limitation, trapezoidal shaped in lateral cross-section and/or a C-shape cut. In addition, while FIG. 2 depicts the projectile 100 as possessing three grooves 224, in one or more embodiments, there may be one, two, four, or more grooves. In one or more embodiments there may be a single groove that extends across a significant portion of the barrel-engaging region. For examples of types and shapes of circumferential grooves see U.S. Pat. No. 10,001,355, incorporated by reference herein in its entirety.

In addition, in certain embodiments, while the grooves reduce the overall volume of material within the projectile by creating voids or empty spaces, in certain embodiments, the density of material selected for the plug portion 220 and/or the penetration portion 216 can be selected to compensate for the overall reduction in total material of the interior core 124.

Figure 3:
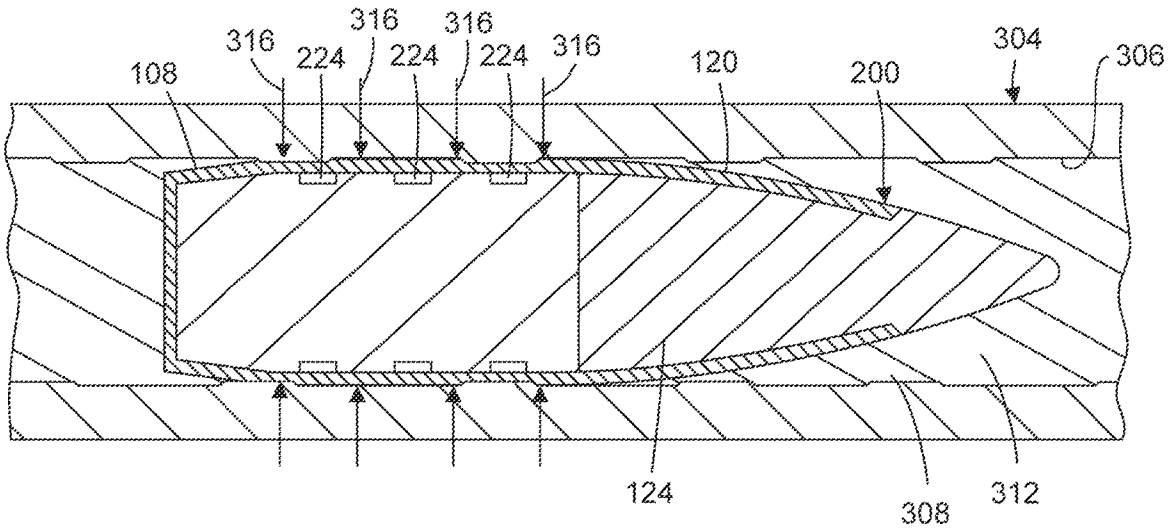
FIG. 3 depicts a cross-sectional view of a projectile in a rifled barrel, according to one or more embodiments of the disclosure.

Referring additionally to FIG. 3, a cross-sectional view of the projectile 200 is depicted while traveling down a rifled barrel 304, according to one or more embodiments. In various embodiments, the barrel 304 if rifled, having a helical groove pattern that is machined into the interior surface 306 of the barrel 304 for the purpose of exerting torque and imparting a spin to a projectile 200 around its longitudinal axis during shooting. In such embodiments this spin serves to gyroscopically stabilize the projectile 200 by conservation of angular momentum, improving its aerodynamic stability and significantly improving both range and accuracy of the projectile 200.

In one or more embodiments the helical groove pattern of the barrel 304 includes alternating lands 308 and grooves 312, where grooves 312 are cut out spaces that define the raised ridges or lands 308. In various embodiments these lands 308 and grooves 312 can vary in number, depth, shape, direction of twist (right or left), and twist rate.

In operation, as the projectile 200 travels down the bore of the barrel 304, the interior surface 306 of the barrel 304 contacts with the barrel-engaging region of the projectile 200. In particular, the raised lands 308 of the interior surface 306 directly contacts the material of the metal jacket 120 and applies pressure to the surface of the metal jacket 120. Depicted in FIG. 3, a series of arrows 316 depict regions where the greatest amount of pressure is applied onto the metal jacket 120.

As shown in FIG. 3, the addition of the circumferential grooves 224 allows for jacket 120 material and/or interior core 124 material to flow and displace in a relatively unconstrained manner into the void left by one or more of the grooves 224. As a result, in various embodiments the overall radial stiffness of the projectile 200 in the barrel-engaging region is significantly reduced.

For example, referring additionally to FIGS. 4A, 4B, 4C, & 4D, a side view of the projectile 200 after being fired from the rifled barrel 304 and close-up cross-sectional views of the projectile 200 after being fired from the rifled barrel 304 are depicted, according to one or more embodiments. In various embodiments the lands 308 of the barrel 304 form corresponding rifling grooves 404 in the material of the metal jacket 120. In such embodiments, depending upon the placement of the groove 404, material of the metal jacket 120 and material of the interior core 124 is displaced into the void left by the circumferential groove 224.

Figure 4A:
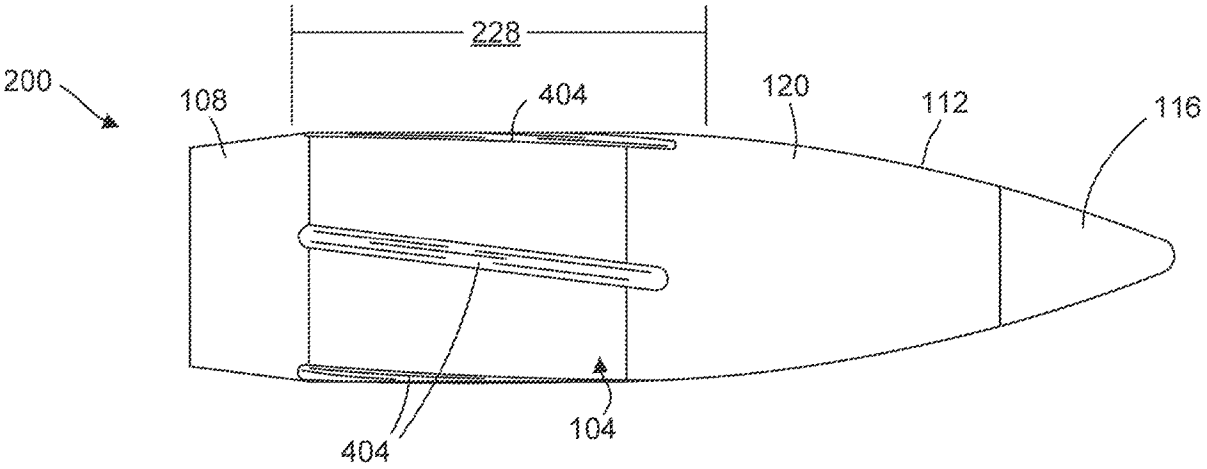
FIG. 4A depicts a side view of a projectile after being fired from a rifled barrel, according to one or more embodiments of the disclosure.
Figure 4C:
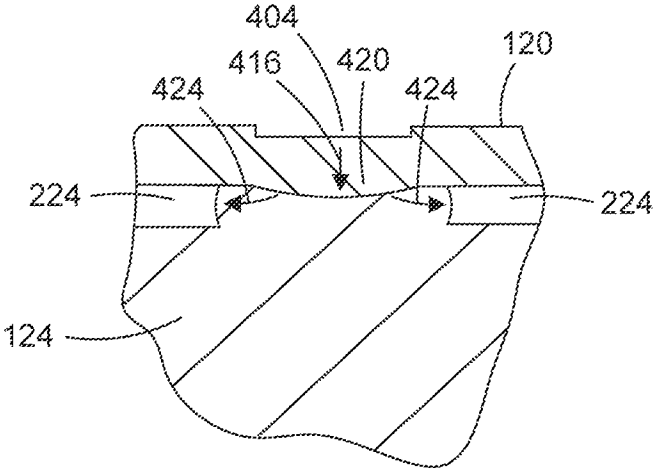
FIGS. 4B, 4C, & 4D depict close-up cross-sectional views of the projectile after being fired from a rifled barrel, according to one or more embodiments of the disclosure.
Figure 4B:
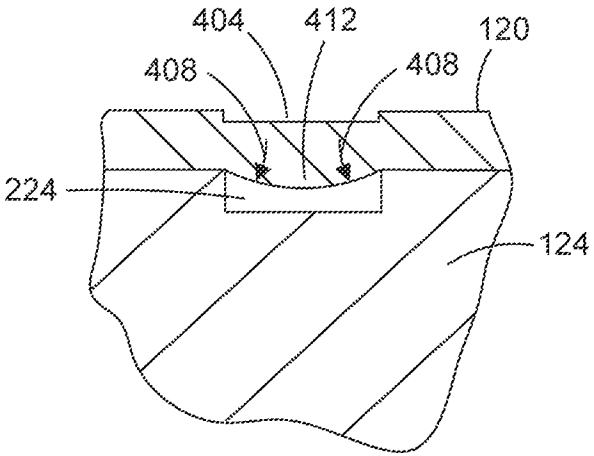

For instance, in FIG. 4B, the groove 404 is placed substantially over the groove 224. As a result, the material of the metal jacket 120 is displaced radially inward in a direction indicated by arrows 408 into the groove 224 such that a bulge 412 is formed. In FIG. 4C, the groove 404 is placed between the grooves 224. As a result, the material of the metal jacket is displaced radially inward in a direction indicated by arrow 416 to form bulge 420. In addition, the material of the interior core 124 is displaced in a direction indicated by arrows 424 into the void created by the grooves 224 to allow for the radial displacement of the metal jacket 120.

Figure 4D:
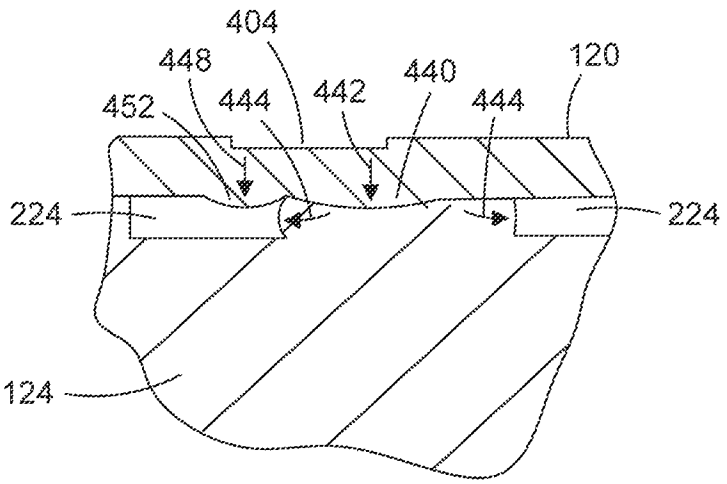

In FIG. 4D, the groove 404 is placed partially over the groove 224 and partially between the grooves 224. As a result, the material of the metal jacket 120 is displaced radially inward in a direction indicated by arrow 442 to form bulge 440, with the material of the interior core 124 is displaced in a direction indicated by arrows 444 into the void created by the grooves 224 to allow for the radial displacement of the metal jacket 120. In addition, the material of the metal jacket 120 is displaced radially inward in a direction indicated by arrow 448 into the groove 224 such that a bulge 452 is formed In one or more embodiments the deformation/radial displacement of the metal jacket 120 is in the range of 0.002 inches to 0.008 inch. In some embodiments the deformation of the metal jacket 120 is approximately 0.004 inches radially inwardly.

Figure 5:
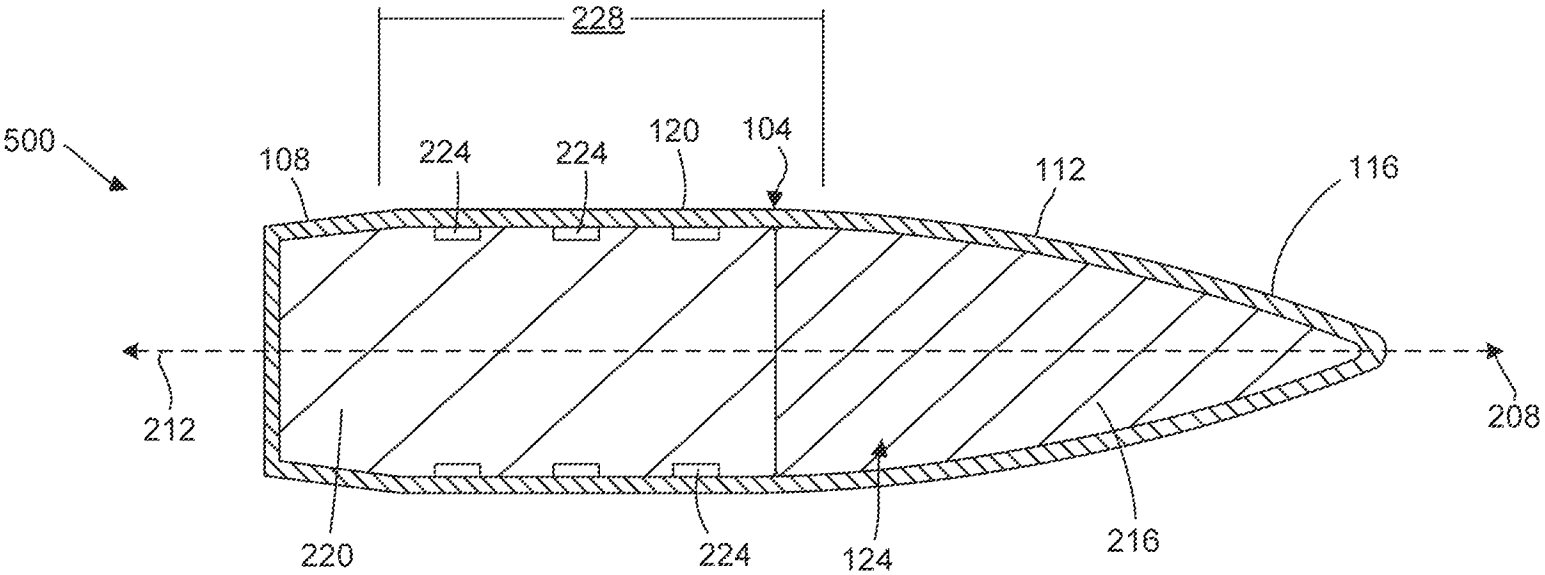
FIG. 5 depicts a cross-sectional view of a projectile, according to one or more embodiments of the disclosure.

Referring to FIG. 5, a cross-sectional view of a projectile 500 is depicted, according to one or more embodiments of the disclosure. In various embodiments, the projectile 500 shares one or more like elements with the projectile 200 of FIG. 2. As such, like elements are referred to with the same reference numbers. Projectile 500 is jacketed, including a projectile body 104 composed of a metal jacket 120 extending from the tail portion 108 to the nose portion 112 and surrounding an interior solid core 124. Depicted in FIG. 5, the metal jacket 120 covers the entirety of the interior core 124 and extends from the tail portion 108 and covers the entirety of the tip portion 116.

Depicted in FIG. 5, the interior solid core 124 of the projectile 500 is composed of two portions including a penetrator portion 216 making up a most forward portion of the interior core 124 and a plug portion 220 that is positioned rearward of the penetrator portion 216. As described above, in various embodiment the penetrator portion 216 is composed of materials having a high stiffness or lesser malleability than the generally more malleable metal jacket 120 and/or plug portion 220. In addition, in one or more embodiments the plug portion 220 includes a plurality of circumferential grooves 224 positioned adjacent to the metal jacket 120 and within a barrel-engaging region 228 of the projectile 500.

Figure 6:
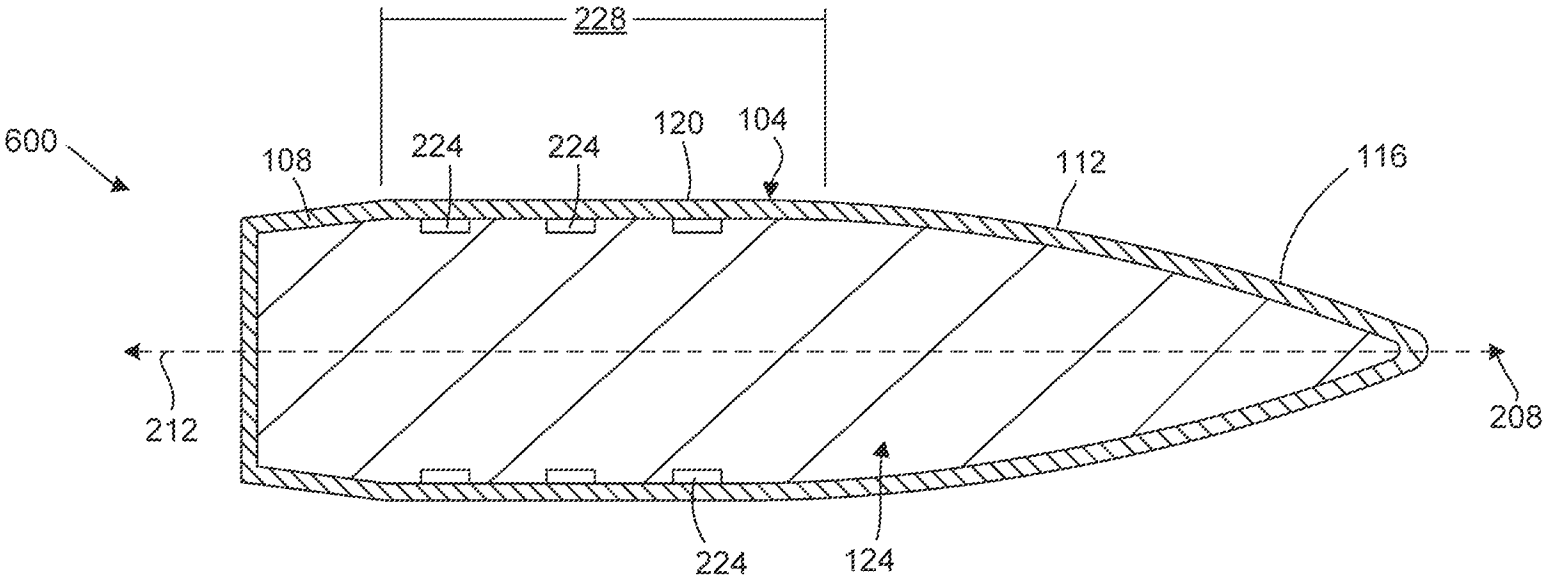
FIG. 6 depicts a cross-sectional view of a projectile, according to one or more embodiments of the disclosure.

Referring to FIG. 6, a cross-sectional view of a projectile 600 is depicted, according to one or more embodiments of the disclosure. In various embodiments, the projectile 600 shares one or more like elements with the projectile 200 of FIG. 2. As such, like elements are referred to with the same reference numbers. Projectile 600 is jacketed, including a projectile body 104 composed of a metal jacket 120 extending from the tail portion 108 to the nose portion 112 and surrounding an interior solid core 124. Depicted in FIG. 6, the metal jacket 120 covers the entirety of the interior core 124 and extends from the tail portion 108 and covers the entirety of the tip portion 116.

Depicted in FIG. 6, the interior solid core 124 of the projectile 600 is composed of from a single material. In certain embodiments the interior core 124 is composed from a generally malleable material, relative to the metal jacket 120 for assisting in expansion of the projectile body 104 upon impact with a target. In some embodiments, the interior solid core 124 is composed of lead, alloyed lead, or other suitable core material for assisting in expansion of the projectile body 104 upon impact. In some embodiments, interior solid core 124 is composed of materials having a higher stiffness or lesser malleability than the generally malleable materials described above. For example in certain embodiments the interior solid core 124 is composed of copper, brass, a copper alloyed with another metal, steel or other suitable material.

In addition, in one or more embodiments the interior core 124 includes a plurality of circumferential grooves 224 positioned adjacent to the metal jacket 120 and within a barrel-engaging region 228 of the projectile 600.

Figure 7:
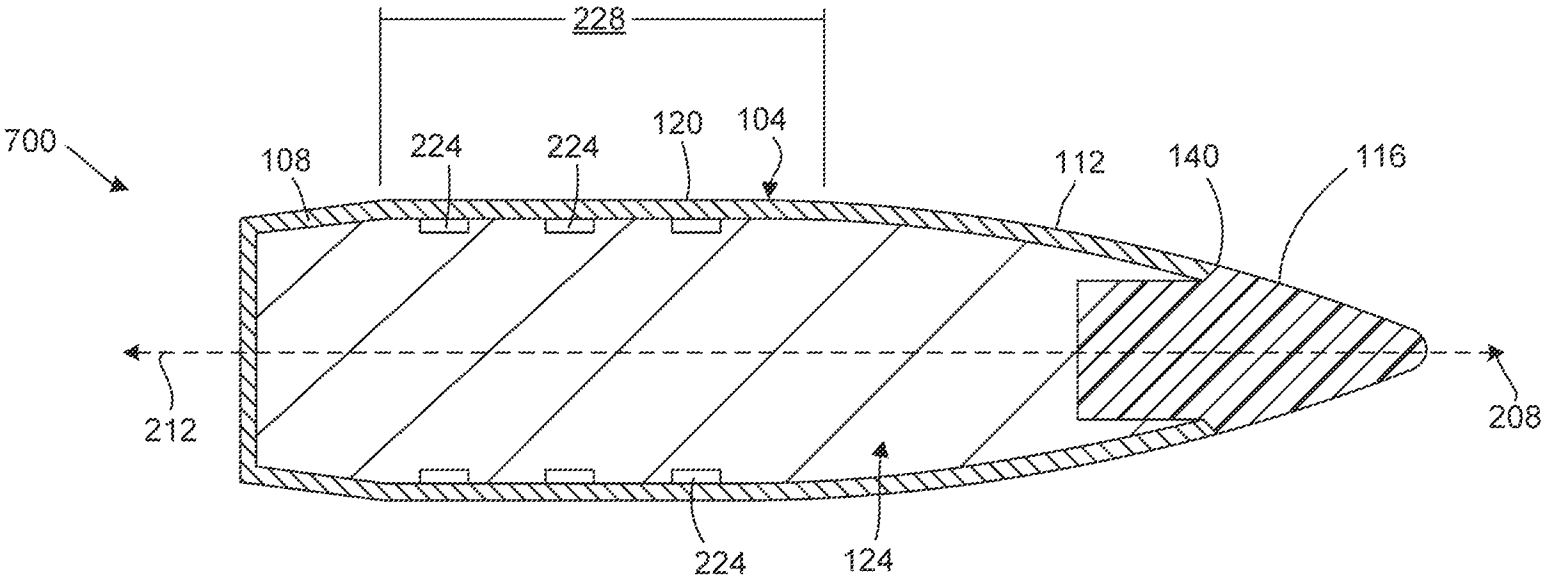
FIG. 7 depicts a cross-sectional view of a projectile, according to one or more embodiments of the disclosure.

Referring to FIG. 7, a cross-sectional view of a projectile 700 is depicted, according to one or more embodiments of the disclosure. In various embodiments, the projectile 700 shares one or more like elements with the projectile 200 of FIG. 2. As such, like elements are referred to with the same reference numbers. Projectile 700 is jacketed, including a projectile body 104 composed of a metal jacket 120 extending from the tail portion 108 to the nose portion 112 and surrounding an interior solid core 124. Depicted in FIG. 7, the metal jacket 120 extends to a forward portion 140 where the metal jacket terminates 120 and a tip portion 116 is exposed. In various embodiments, the tip portion 116 is composed of a polymer material where the tip portion 116 is inserted into a recess defined by the interior core 124. When inserted, the tip portion 116 has an exterior surface 128 that is substantially flush with an exterior surface 132 of the metal jacket 120 and extends from a rearward portion 136 to a forward point 144.

Depicted in FIG. 7, the interior solid core 124 of the projectile 700 is composed of from a single material. In certain embodiments the interior core 124 is composed from a generally malleable material, relative to the metal jacket 120 for assisting in expansion of the projectile body 104 upon impact with a target. In some embodiments, the interior solid core 124 is composed of lead, alloyed lead, or other suitable core material for assisting in expansion of the projectile body 104 upon impact. In some embodiments, interior solid core 124 is composed of materials having a higher stiffness or lesser malleability than the generally malleable materials described above. For example in certain embodiments the interior solid core 124 is composed of copper, brass, a copper alloyed with another metal, steel or other suitable material.

In addition, in one or more embodiments the interior core 124 includes a plurality of circumferential grooves 224 positioned adjacent to the metal jacket 120 and within a barrel-engaging region 228 of the projectile 700.

Additional discussion of polymer tipped projectiles is found, for example, in U.S. patent application Ser. Nos. 15/294,171 and 15/870,769. These patent applications are incorporated by reference herein in their entirety.

Figure 8:
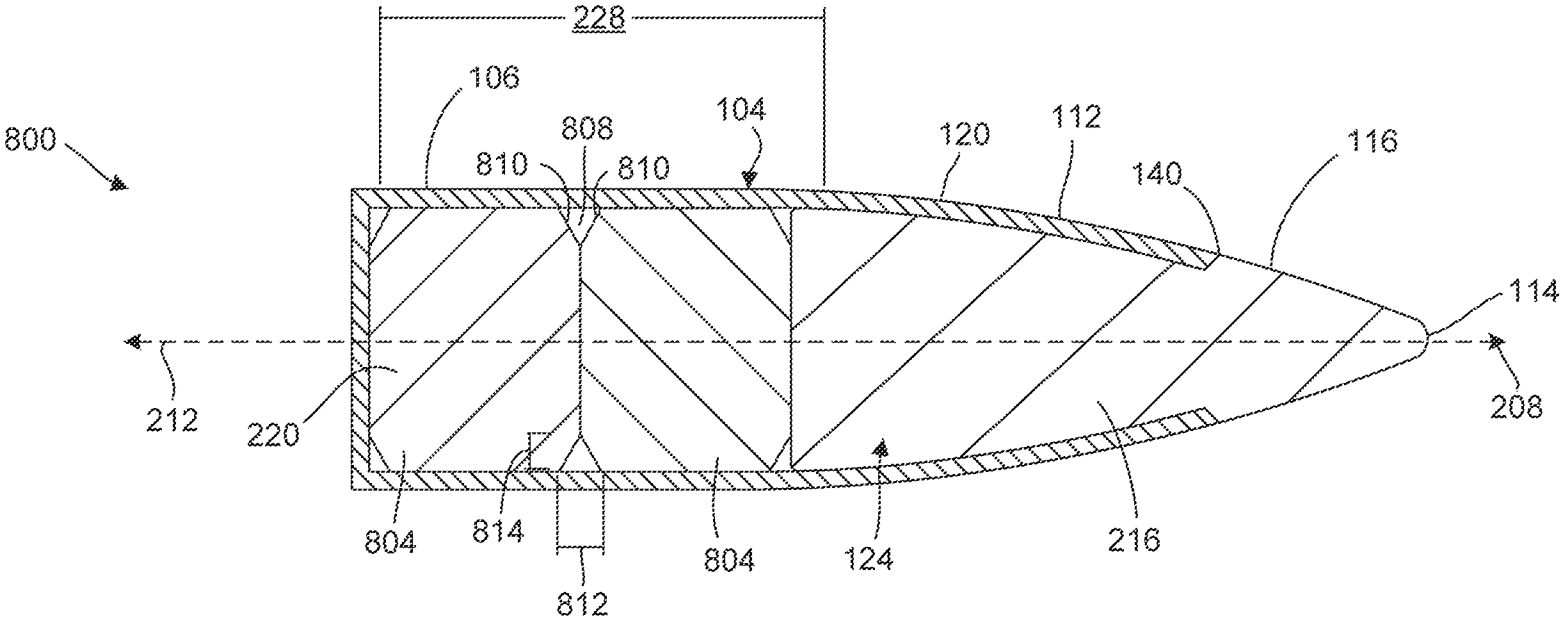
FIG. 8 depicts a cross-sectional view of a projectile, according to one or more embodiments of the disclosure.

Referring to FIG. 8 a cross-sectional view of a projectile 800 is depicted, according to one or more embodiments of the disclosure. In various embodiments, the projectile 800 shares one or more like elements with the projectile 200 of FIG. 2. As such, like elements are referred to with the same reference numbers. Projectile 800 is jacketed, including a projectile body 104 composed of a metal jacket 120 surrounding an interior solid core 124. Depicted in FIG. 8, the metal jacket 120 extends to a forward portion 140 where the metal jacket terminates 120 and a tip portion 116 is exposed. Depicted in FIG. 8, the interior solid core 124 of the projectile 200 is composed of two portions including a penetrator portion 216 making up a most forward portion of the interior core 124 and a plug portion 220 that is positioned rearward of the penetrator portion 216. Depicted in FIG. 8, in certain embodiments the projectile does not include a tail portion, and instead extends from the main body 106 to the nose portion 112.

Additionally depicted in FIG. 8, the plug portion 220 is composed of a plurality of segments 804, 808. In one or more embodiments, each of the segments 804 are separable from one another such that the segments 804 of the projectile 800 are configured to break apart and function as individual projectiles upon impact of the larger projectile 800 with a target. In various embodiments, and depicted in FIG. 8, the plug portion 220 includes two individual segments 804. However, in certain embodiments the plug portion could include three or more individual segments 804.

In one or more embodiments each of the individual segments 804 have tapered corner portions 810. As a result, when each of the segments 804 are positioned adjacent the tapered corner portions 810 define a circumferential groove 808 positioned adjacent to the metal jacket 120 and within a barrel-engaging region 228 of the projectile 800. As described above, the circumferential groove 808 has an axial width 812 and a radial depth 814 defined by the tapered shape of the tapered corner portions 810.

As described above, in certain embodiments, the circumferential groove 808 has an axial width 812 in the range of 0.5 inches to 0.025 inches. In some embodiments, the circumferential groove 808 has a radial depth in the range of 0.1 inches to 0.0025 inches. However, in certain embodiments, the size of the radial depth 814 and axial width 812 will be larger or smaller than the given ranges. For example, such dimensions could increase or decrease based on the size of the projectile. In various embodiments the groove 808 is contemplated to extend inwardly 4 to 15% of the diameter of the projectile 800 in the barrel-engaging region 228.

Figure 9A:
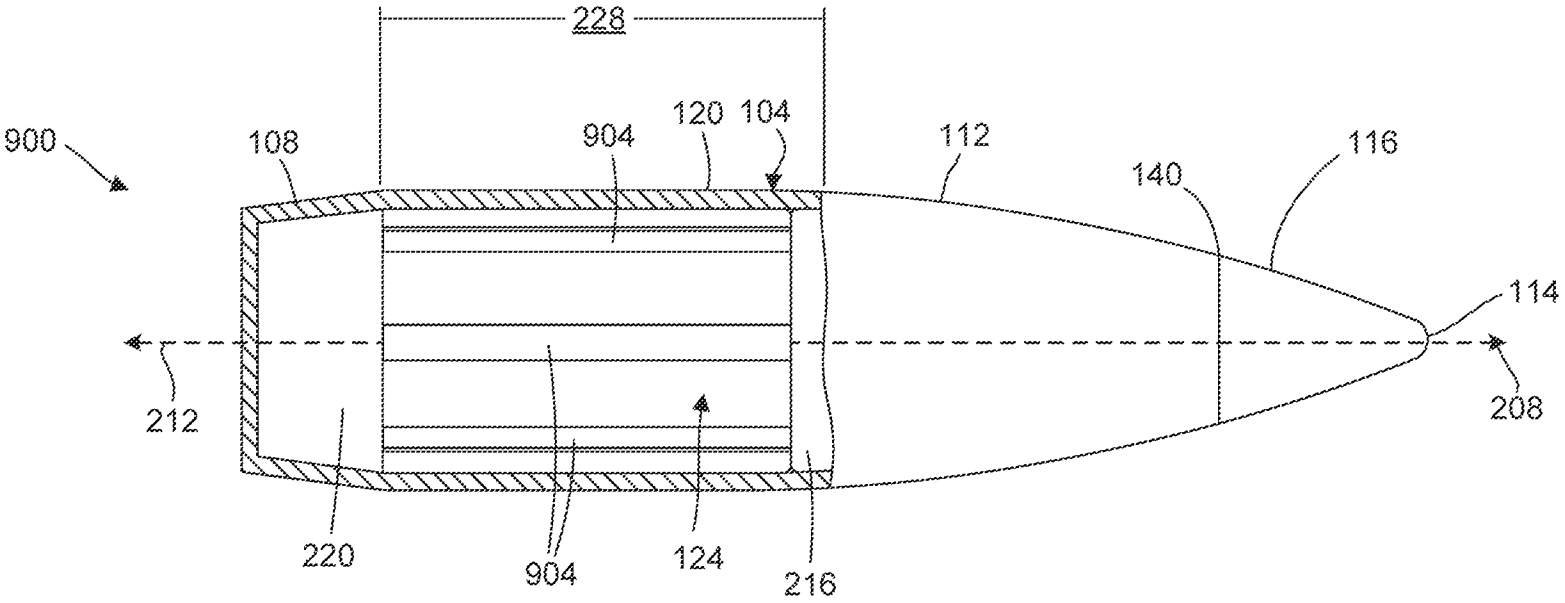
FIG. 9A depicts a partial cross-sectional view of a projectile, according to one or more embodiments of the disclosure.

Referring to FIG. 9A, a partial cross-sectional view of a projectile 900 is depicted, according to one or more embodiments of the disclosure. In various embodiments, the projectile 900 shares one or more like elements with the projectile 200 of FIG. 2. As such, like elements are referred to with the same reference numbers. Projectile 900 is jacketed, including a projectile body 104 composed of a metal jacket 120 surrounding an interior solid core 124. Office of the Governor In one or more embodiments the interior solid core 124 includes a plurality of longitudinal or axial grooves 904. In various embodiments the grooves 904 are voids or cutouts of material from the interior core portion 124. In one or more embodiments, each of the circumferential grooves 904 are positioned adjacent to the metal jacket 120 and within a barrel-engaging region 228 of the projectile 900. As used herein, the barrel-engaging region 228 includes the portion of the projectile that is extended furthest radially outward, relative to central axis 212, such they form the primary elements for contacting barrel rifling and imparting spin on the projectile 900 during firing.

Each of the axial grooves 904 have an axial width 232 and a radial depth, similar as to described above with reference to FIG. 2. In certain embodiments, the axial grooves 904 have an axial width 232 that extends substantially the length of the barrel contacting region 228, as depicted in FIG. 9A. However, in some embodiments, the axial grooves 904 could have a shorter width, depending on the design of the projectile 900. In some embodiments, the circumferential grooves 224 have a radial depth in the range of 0.1 inches to 0.0025.

As described above, in various embodiments the addition of circumferential grooves 904 to the interior core 124 allows jacket 120 material and/or interior core 124 material to flow and displace into the void left by the grooves 904 in a relatively unconstrained manner during firing of the projectile. As a result, in various embodiments, the circumferential grooves provides a significant reduction to overall stiffness to the projectile 900 over the barrel-engaging region 228.

Figure 9B:
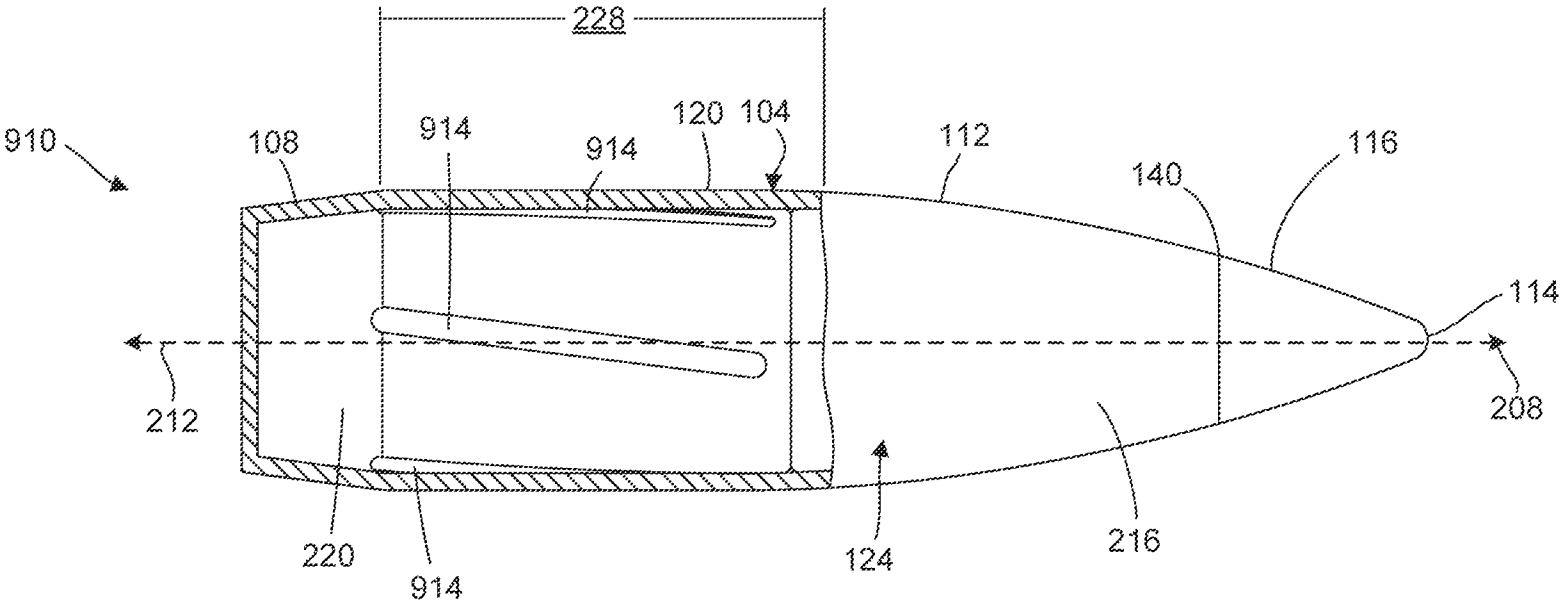
FIG. 9B depicts a partial cross-sectional view of a projectile, according to one or more embodiments of the disclosure.

Referring to FIG. 9B, in certain embodiments a projectile can include grooves that are angled or helical. For example, projectile 910 is depicted in FIG. 9B having a plurality of axially extending helical grooves 914 positioned adjacent to the metal jacket 120 and within a barrel-engaging region 228 of the projectile 910. In one or more embodiments, the helical grooves 910 have an angle that substantially matches that of barrel rifling. In such embodiments, the position of rifling grooves in the metal jacket 120 formed by the lands of the barrel will be consistently located relative to each of the helical grooves 914, and in some embodiments, the projectile 910 will present a more consistent stiffness when engaging the lands of a rifled barrel along the barrel-engaging region 228.

Figure 10A:
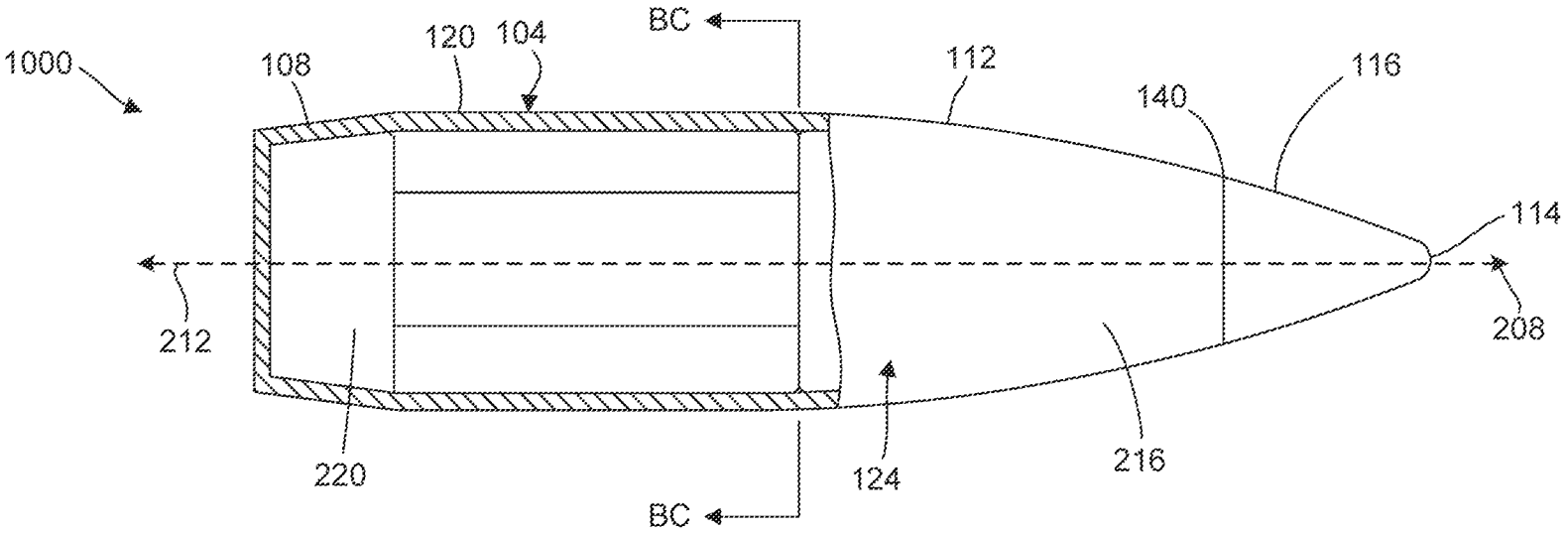
FIG. 10A depicts a partial cross-sectional view of a projectile, according to one or more embodiments of the disclosure.
Figure 10C:
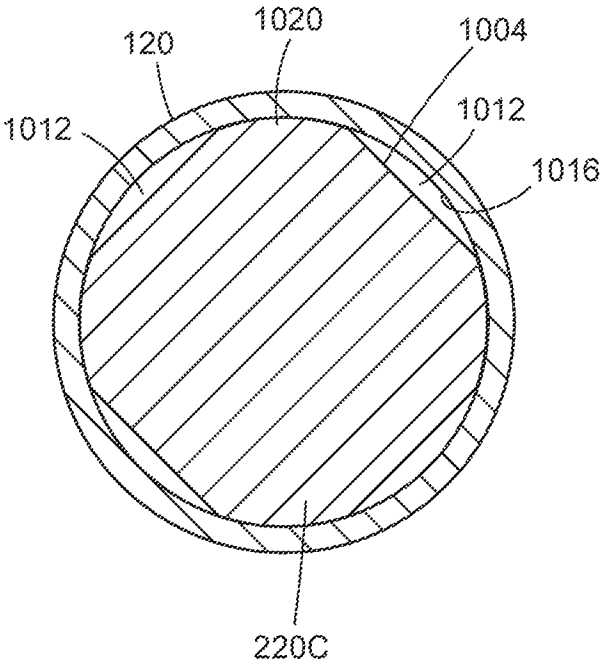
FIGS. 10B & 10C depict front cross-sectional views of a projectile taken at line BC-BC of FIG. 10A, according to one or more embodiments of the disclosure.
Figure 10B:
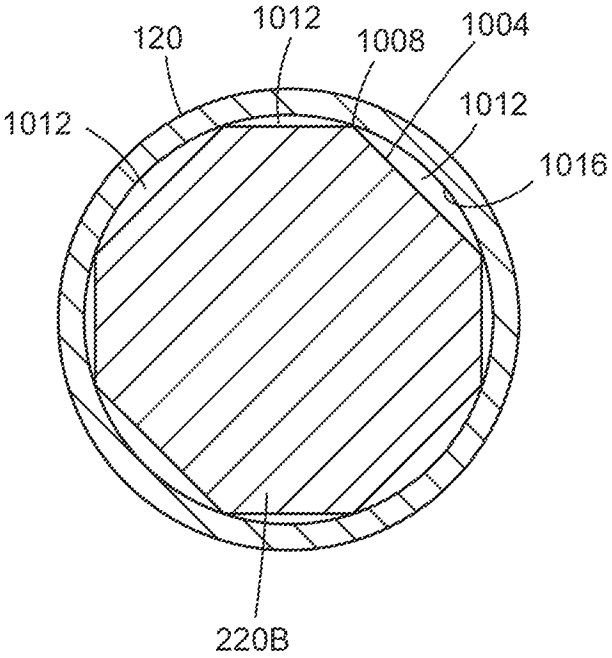

Referring to FIGS. 10A, 10B & 10C, a partial cross-sectional view of a projectile 1000 is depicted, with front cross sectional views of the projectile 1000 taken at line BC-BC, according to one or more embodiments. In various embodiments the plug portion 220 of the interior solid core 124 can be designed to have various shapes. In such embodiments, the shape or design of the plug portion 220 can define one or more voids or grooves within the interior of the projectile for reduction of radial stiffness.

For example, depicted in FIG. 10A, a plug portion 220A is depicted as being substantially hexagonal, having six flat sides 1004 joined at corner portions 1008 at an angle with respect to one another. In such embodiments, the plug portion 220A can define a plurality of axial grooves 1012 in the interior of the projectile 1000 between the flat surfaces of the hexagonal plug portion 220 and the interior surface 1016 of the metal jacket 120. As an additional example, depicted in FIG. 10B, a plug portion 220C can be approximately rectangular with rounded corner portions 1020. In such embodiments, the rounded corner portions 1020 are configured to interface with the interior surface 1016 of the metal jacket 120 to increase the surface area contact between the plug portion 220C and the metal jacket 120. In such, embodiments, the increase in the surface area contact can function to reduce movement of the plug portion 220C to improve flight stability of the projectile 1000.

Figure 11:
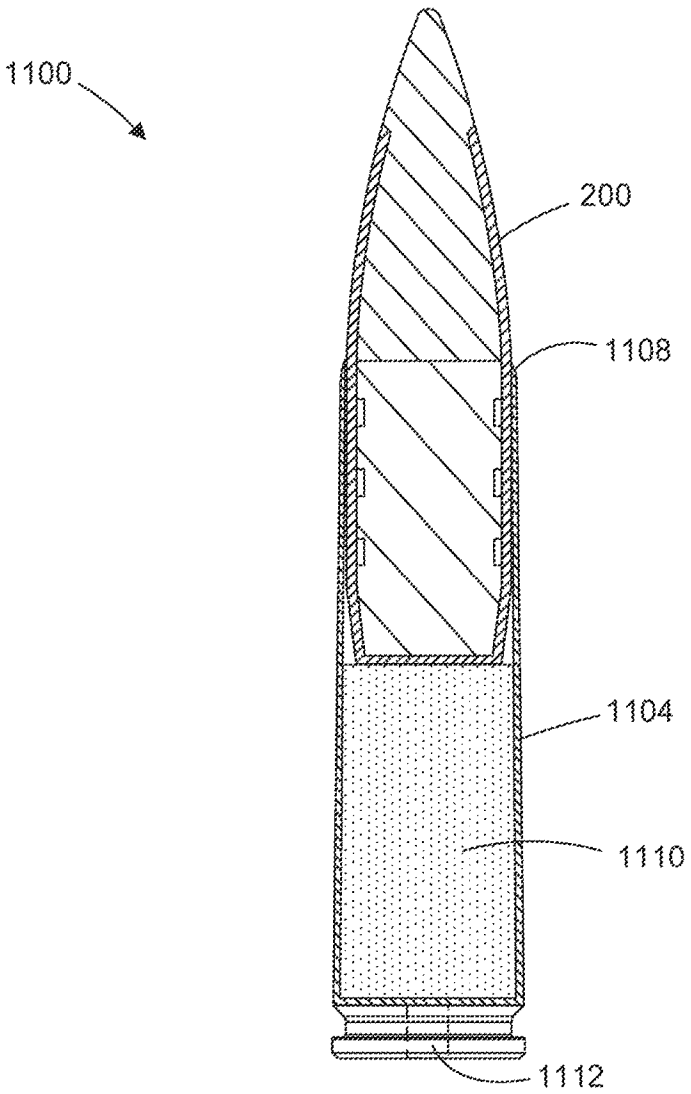
FIG. 11 depicts a cross-sectional view of a cartridge including a projectile, according to one or more embodiments of the disclosure.

Referring to FIG. 11, a cartridge 1100 is depicted, according to one or more embodiments. In various embodiments the cartridge 1100 includes a projectile 200 seated in a casing 1104. An upper lip 1108 of the casing 1104 may be aligned and slightly swaged inwardly whereby a very secure high integrity seal with respect to the interior of the casing 1104 may be formed. In various embodiments a quantity of propellant 1110 is included in the casing 1104 along with a primer 1112 for initiating detonation of the propellant 1110 and for firing the projectile 200.

While the figures herein depict a generally low caliber projectile and ammunition cartridge. It is intended that the disclosure is applicable to any kind of barrel fired spin-stabilized projectile. As such, aspects of the disclosure are applicable to low caliber projectiles having a size of .50 caliber or less, medium caliber projectiles having a size .50 caliber and less than 75 mm, and large caliber projectiles having a size greater than 75 mm.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A projectile having:

a projectile body including a tail portion, a nose portion, a barrel engaging portion between the nose portion and the tail portion, the projectile comprising a metal jacket that extends from the tail portion to at least the nose portion and that defines an exterior of the projectile the metal jacket extending around an interior core, wherein the portions of the projectile body are arranged along a central longitudinal axis; and wherein a plurality of circumferential grooves are defined in the interior core and not in the metal jacket, each of the one or more circumferential grooves covered by and positioned adjacent to the metal jacket;

wherein during firing of the projectile, the one or more circumferential grooves define a void that allows material of the metal jacket and interior core to displace into the void for reduction in radial stiffness to the projectile in the barrel engaging portion.

2. The projectile of claim 1, wherein the nose portion includes a tip portion that forms a spitzer aerodynamic shape for the projectile and that defines a most forward portion for the projectile.

3. The projectile of claim 2, wherein the metal jacket terminates at a forward portion such that the tip portion is not covered by the metal jacket, the tip portion having an exterior surface substantially flush with an exterior surface of the metal jacket.

4. The projectile of claim 1, wherein, each of the one or more circumferential grooves have an axial width and a radial depth, and the axial width has a range of 0.5 inches to 0.025 inches and the radial depth has a range of 0.1 inches to 0.0025 inches.

5. The projectile of claim 1, wherein the one or more circumferential grooves extend inwardly 4% to 15% of a diameter of the projectile in the barrel engaging portion.

6. The projectile of claim 1, wherein the one or more circumferential grooves possess square or rectangular shape in cross section taken in a plane transverse to the grooves.

7. The projectile of claim 1, wherein the interior core includes two or more portions where each portion is composed from a different material.

8. The projectile of claim 7, wherein the interior core includes a forward penetrator portion making up a most forward portion of the interior core and a plug portion that is positioned rearward of the penetrator portion.

9. A projectile having:

a projectile body with a nose portion, a barrel engaging portion rearward of the nose portion, the projectile comprising a metal jacket that extends forwardly to at least the nose portion and defines an exterior of the projectile, the projectile further comprising an interior core within the metal jacket;

the metal jacket having an interior surface engaged with the interior core; and one or more grooves defined in the interior core and comprising a radial depth, each of the one or more grooves covered by and positioned adjacent to the metal jacket;

wherein before firing of the projectile, a majority of the interior surface of the metal jacket within the barrel engaging portion is in contact with the inner core; and wherein during firing of the projectile, the one or more grooves define a void that allows material of the metal jacket and interior core to displace into the void for reduction in radial stiffness to the projectile in the barrel engaging portion.

10. The projectile of claim 9, wherein each of the one or more grooves are arranged circumferentially on the interior core.

11. The projectile of claim 9, wherein the interior core is composed of one or more of aluminum, antimony, beryllium, bismuth, boron carbide, brass, bronze, chromium, cobalt, copper, gold, iridium, iron, lead, magnesium, mercury, molybdenum, nickel, palladium, platinum, rhodium, silicon carbide, silver, steel, tantalum, tellurium, tin, titanium, tungsten, tungsten carbide, depleted uranium, zinc and zirconium, and an alloy thereof.

12. The projectile of claim 9, wherein the interior core includes two or more portions where each portion is composed from a different material.

13. The projectile of claim 12, wherein the interior core includes a forward penetrator portion making up a most forward portion of the interior core and a plug portion that is positioned rearward of the penetrator portion.

14. The projectile of claim 13, wherein the penetrator portion is composed of materials having a high stiffness or lesser malleability than one or more of the metal jacket and the plug portion.

15. The projectile of claim 14, wherein the penetrator portion is composed of steel and the plug portion is composed of one or more of copper, brass, a copper alloy, and lead.

16. The projectile of claim 9, wherein the nose portion includes a tip portion that forms a spitzer aerodynamic shape for the projectile and that defines a most forward portion for the projectile.

17. The projectile of claim 16, wherein the metal jacket terminates at a forward portion such that the tip portion is not covered by the metal jacket, the tip portion having an exterior surface substantially flush with an exterior surface of the metal jacket, the metal jacket extending from a rearward portion to a forward point of the projectile.

18. The projectile of claim 1, wherein the metal jacket comprises copper and the interior core comprises steel or copper.

19. The projectile of claim 9, wherein the metal jacket comprises copper and the interior core comprises steel or copper.

20. The projectile of claim 1, wherein each of the plurality of circumferential grooves are positioned at the barrel engaging portion.

* * * * *